US008902033B2

(12) United States Patent
Shepard et al.

(10) Patent No.: US 8,902,033 B2
(45) Date of Patent: Dec. 2, 2014

(54) SEALED INDUCTOR CONNECTION USING LITZ WIRE

(75) Inventors: Charles Shepard, DeKalb, IL (US); Kris H. Campbell, Poplar Grove, IL (US); Adam M. Finney, Rockford, IL (US); Robert Scott Downing, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 30 days.

(21) Appl. No.: 13/449,686

(22) Filed: Apr. 18, 2012

(65) Prior Publication Data

US 2013/0278369 A1 Oct. 24, 2013

(51) Int. Cl.

| | |
|---|---|
| ***H01F 27/10*** | (2006.01) |
| ***H01F 27/02*** | (2006.01) |
| ***H01F 27/29*** | (2006.01) |

(52) U.S. Cl.

USPC ..... 336/58; 336/55; 336/82; 336/90; 336/192

(58) Field of Classification Search

CPC ..... H01F 27/12; H01F 27/14; H01F 27/125; H01F 27/321; H01F 27/02; H01F 27/255; H01F 27/2895; H01F 30/16; H01F 19/04; H01B 3/20

USPC ..... 336/55–59, 82, 90, 92, 192, 229

See application file for complete search history.

(56) References Cited

U.S. PATENT DOCUMENTS

| | | | | |
|---|---|---|---|---|
| 4,115,840 | A * | 9/1978 | Horton | 361/782 |
| 5,226,220 | A * | 7/1993 | Gevas et al. | 29/605 |
| 7,690,936 | B1 * | 4/2010 | Snekkevik et al. | 439/281 |
| 2012/0128512 | A1 * | 5/2012 | Vande Sande et al. | 417/410.1 |

* cited by examiner

*Primary Examiner* — Elvin G Enad
*Assistant Examiner* — Kazi Hossain
(74) *Attorney, Agent, or Firm* — Kinney & Lange, P.A.

(57) ABSTRACT

An inductor comprises a ferromagnetic core, a litz wire conductor encircling the ferromagnetic core, a housing, a bobbin, a conductive pin, and a seal assembly. The housing encloses the ferromagnetic core and the litz wire conductor. The conductive pin is conductively attached to the litz wire conductor, and extends therefrom to form an external electrical contact. The bobbin supports the litz wire conductor and positions the conductive pin in alignment with an aperture in the housing which is sealed against fluid egress by the seal assembly.

20 Claims, 6 Drawing Sheets

SEALED INDUCTOR CONNECTION USING LITZ WIRE

BACKGROUND

The present invention relates generally to ferromagnetic core inductors, and more particularly to a sealed connection to inductor coils in a sealed housing.

Inductors are passive electronic components which store electrical energy in magnetic fields. Ferromagnetic core inductors have two principal components: a rigid core of ferromagnetic or ferrimagnetic material, and a conductor, usually wound about the core in one or more turns. Some inductors include multiple coils dedicated to distinct voltage phases. Inductors are characterized by an inductance L which resists changes in current through the conductor. According to Faraday's law, the magnetic flux induced by changing current through the conductor generates an opposing electromotive force opposing the change in voltage. For a ferromagnetic inductor with a rectangular cross-section toroidal core, $$L = 0.01170 N^2 h \log_{10} \frac{d_2}{d_1}$$

Where L=inductance (μH), $\mu_0$=permeability of free space=$4\pi*10^{-7}$ H/m, N=number conductor turns, h=core height (in), $d_1$=core inside diameter (in), and $d_2$=core outside diameter (in).

Many inductors use conductors formed of litz wire. Litz wire is made up of bundles of individually insulated wires. A single litz wire may comprise hundreds of these individually insulated parallel wires.

Real-world inductors are not perfectly energy efficient. During operation, ferromagnetic core inductors radiate heat both from core losses, and from series resistance. Accordingly, inductors in commercial or industrial applications may be cooled utilizing liquid or immersion cooling. Liquid and immersion cooling configurations house the inductor within a sealed housing containing a coolant fluid. At least one connection with the conductor extends through the housing, allowing the inductor to be contacted externally.

Litz wires are difficult to seal when utilizing liquid or immersion cooling. Because each litz wire is made up of many individually insulated wires, a litz wire connection through a sealed inductor housing may allow coolant fluid to leak between individually insulated wires.

SUMMARY

The present invention is directed toward an inductor comprising a ferromagnetic core, a litz wire conductor encircling the ferromagnetic core, a housing, a bobbin, a conductive pin, and a seal assembly. The housing encloses the ferromagnetic core and the litz wire conductor. The conductive pin is conductively attached to the litz wire conductor, and extends therefrom to form an external electrical contact. The bobbin supports the litz wire conductor and positions the conductive pin in alignment with an aperture in the housing which is sealed against fluid egress by the seal assembly.

DETAILED DESCRIPTION

Figure 1:
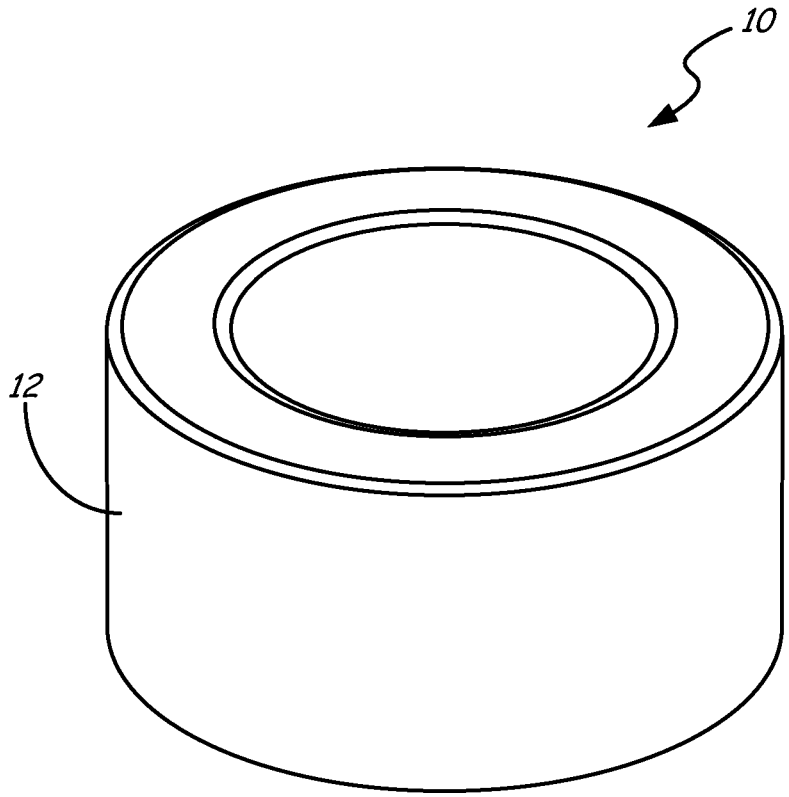
FIG. 1 is a perspective view of a core of an inductor according to the present invention.

FIG. 1 is a perspective view of a core 12 of inductor 10. Inductor 10 is a ferromagnetic core inductor, and core 12 is a toroidal ferromagnetic core with a rectangular cross-section. Core 12 is formed of a material with high magnetic permeability, such as iron or ferrite. During operation of inductor 10, core 12 serves to confine magnetic fields induced by changing current through conductors 16 (see FIG. 2, below). Alternative embodiments of inductor 10 may include variants of core 12 with non-rectangular cross-sections, or which are not toroidal in shape.

Figure 2:
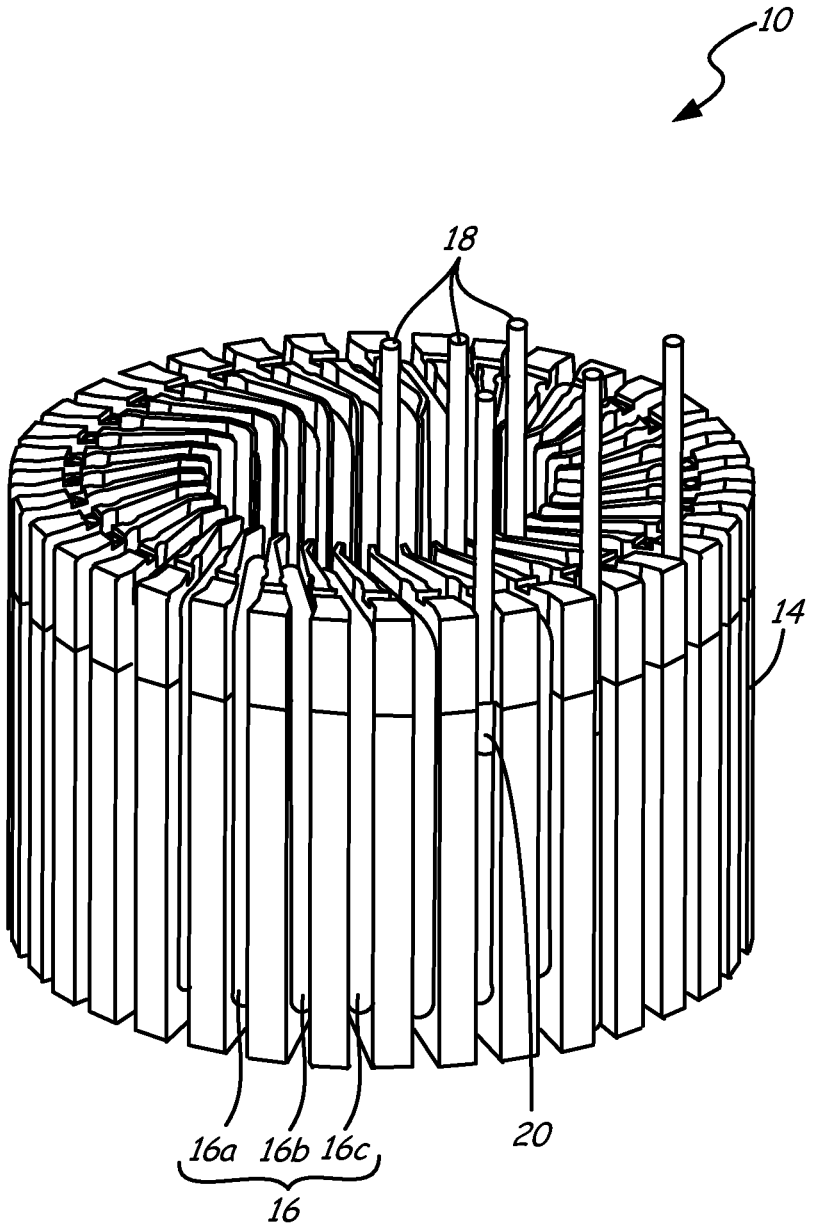
FIG. 2 is a perspective view of the inductor of FIG. 1.

FIG. 2 is a perspective view of inductor 10, including bobbin 14, conductors 16 (including coils 16*a*, 16*b*, and 16*c*), pins 18, and conductor-pin connection 20. Core 10 of FIG. 1 is enclosed within bobbin 14. As described above with respect to FIG. 1, inductor 10 is a conventional ferromagnetic core inductor. Conductors 16 are conductive coils which wrap about core 12. In the depicted embodiment, conductors 16 include three distinct coils 16*a*, 16*b*, and 16*c* dedicated to distinct voltage phases, each coil having two separate pins 18. Pins 18 are electrical contact points to conductors 16, which allow inductor 10 to be accessed externally when sealed inside housing 22 (see FIG. 3, below). Bobbin 14 is a rigid or semi-rigid support structure which positions and restrains conductors 16 about core 12. Bobbin 14 maintains desired spacing between conductors 16, and ensures that pins 18 are located appropriately to interface with apertures in housing 22. Bobbin 14 does not provide a fluid seal about core 12; rather, fluid may pass through or around bobbin 14 to cool core 12 and conductors 16. Bobbin 14 has grooves or wire channels shaped to retain conductors 16 and pins 18 in predetermined locations.

Conductors 16 are formed of litz wire, thereby providing many inductor turns with each coil 16*a*, 16*b*, or 16*c*. Conductors 16 make contact with pins 18 at conductor-pin connection 20, where the individually insulated wires of one coil 16*a*, 16*b*, or 16*c* are stripped and fitted to pin 18, as described in greater detail below. Pins 18 are solid conductive rods which can be sealed in a variety of ways (see FIGS. 4*a*, 4*b*, and 4*c*) with respect to housing 22. Each coil 16*a*, 16*b*, or 16*c* contacts two pins 18, as noted above. For each coil 16*a*, 16*b*, or 16*c*, one pin 18 is located at an inner diameter wall of bobbin 14, and another at an outer diameter wall of bobbin 14. All pins 18 are oriented parallel to each other, and to a central axis of core 12. In alternative embodiments, coils 16*a*, 16*b*, and 16*c* need not necessarily be parallel, and may be mounted in different locations on bobbin 14.

Pins 18 act as electrical contact points which do not present the sealing difficulties inherent to litz wire. By connecting pins 18 to conductors 16, inductor 10 retains the improved performance provided by litz wire, while allowing inductor 10 to be enclosed in a sealed housing for fluid or immersion cooling.

Figure 3:
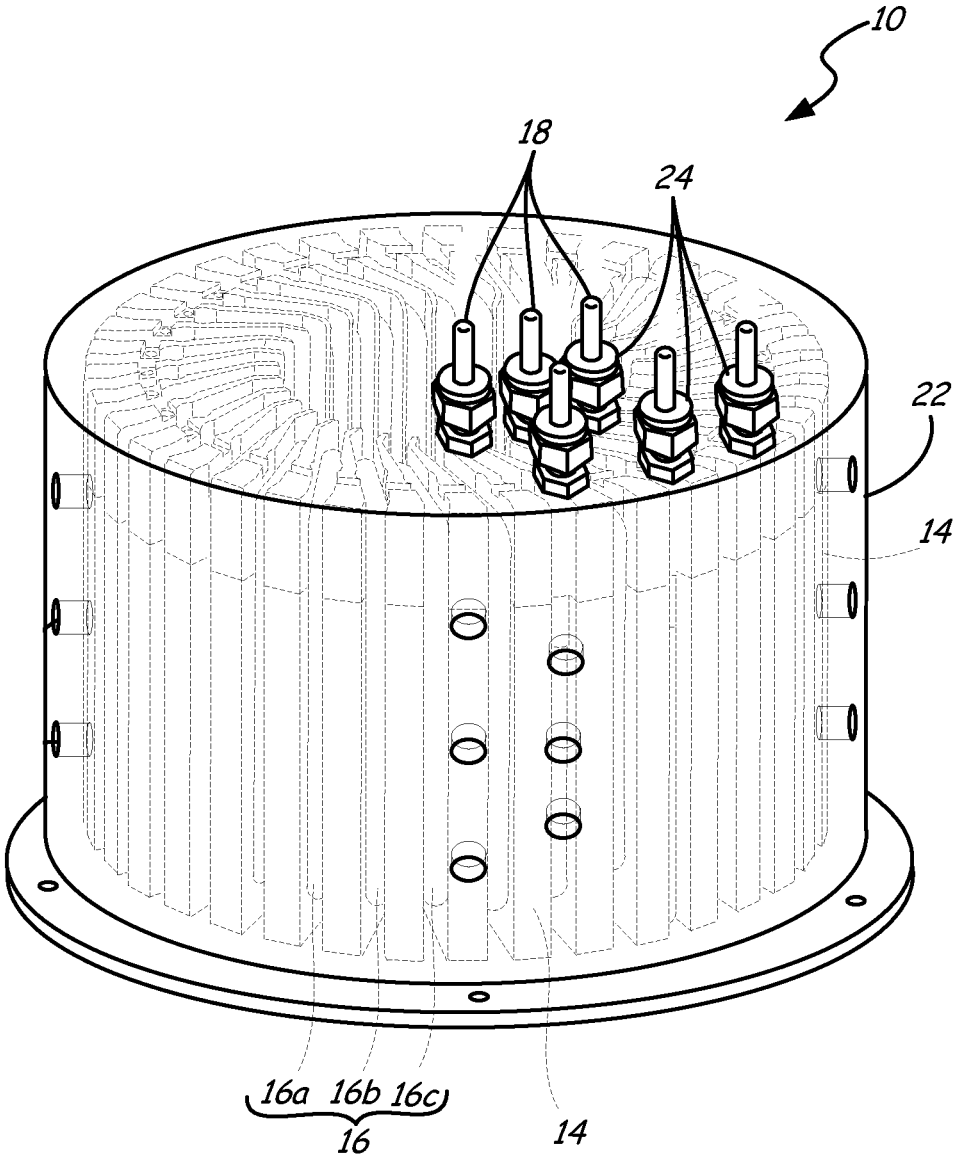
FIG. 3 is a perspective view of the inductor of FIG. 2 within a protective casing.

FIG. 3 is a perspective view of inductor 10, comprising bobbin 14, conductors 16, pins 18, housing 22, and compression tube seals 24. Bobbin 14 and conductors 16 are shown in ghost profile through housing 22. Housing 22 is a sealed enclosure which surrounds bobbin 14. In the depicted embodiment, housing 22 is an open shell configured to be bolted to a flat surface, thereby fully enclosing core 12, bobbin 14, and conductors 16. In other embodiments, housing 22 may be a closed shell comprised of two or more independent pieces. Housing 22 retains coolant fluid which serves to cool core 12 and conductors 16 by immersion or fluid cooling. Coolant fluid need not fill the entirety of the interior of housing 22; during operation, heat from core 12 and conductors 16 will vaporize liquid coolant. The resulting coolant vapor will circulate throughout the interior of housing 22, thereby providing convection cooling to core 12 and conductors 16.

Housing 22 includes apertures 26 (see FIGS. 4*a*, 4*b*, and 4*c*) collocated with and covered by compression tube seals 24. Apertures 26 are obscured by compression tube seals 24 in FIG. 3, but can be seen in FIGS. 4*a*, 4*b*, and 4*c*. Apertures 26 are holes or openings in housing 22 aligned with pins 18. As discussed above with respect to FIG. 2, bobbin 14 serves to retain conductors 16 and pins 18 in substantially fixed relative locations, so that pins 18 are able to pass through apertures 26 when housing 22 is installed about bobbin 14. Pins 18 extend through apertures 26, and form external electrical connections by which inductor 10 can be connected to other electronics.

The orientation of inductor 10 in FIG. 3 is selected to show pins 18 and compression tube seals 24, and is not intended to indicate an installation orientation of inductor 10. Inductor 10 may, for instance, be installed upside-down from the depicted orientation, such that pins 18 are situated in a bottom portion of housing 22. This orientation allows pins 18 to be substantially submerged in coolant liquid.

Compression tube seals 24 form fluid seals between pins 18 and housing 22 at apertures 26. Compression tube seals 24 comprise only one of several possible sealing mechanisms for housing 22 and pins 18, three of which are discussed in further detail with respect to FIGS. 4*a*, 4*b*, and 4*c*. All such sealing mechanisms form fluid seals which isolate the interior of housing 22 from its exterior, while facilitating an external electrical connection with pins 18.

Figure 4A:
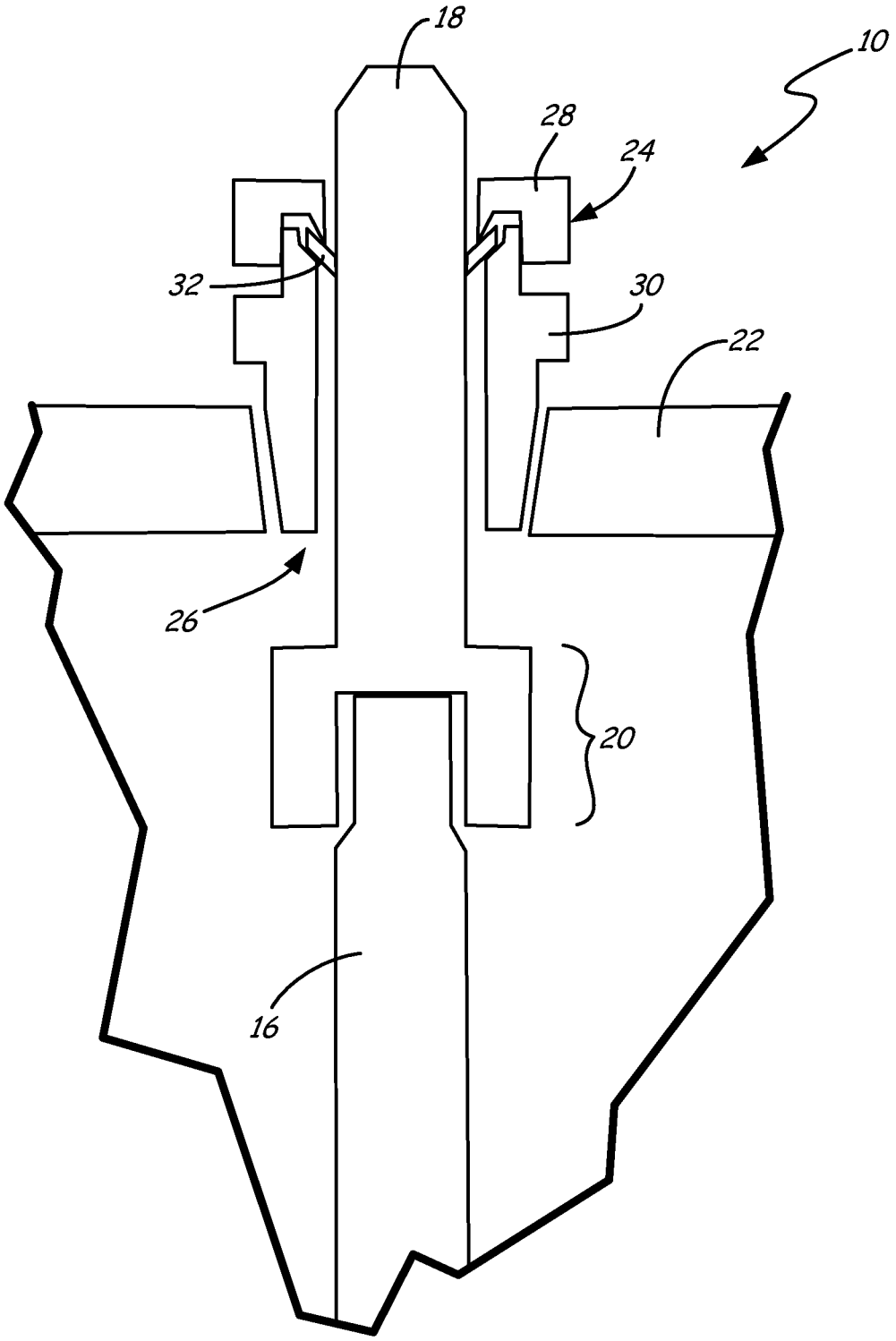
FIG. 4*a* is a simplified cross-sectional view of a first embodiment of a sealed connection for the inductor of FIG. 2.

FIG. 4*a* is a simplified cross-sectional view of inductor 10, focusing on the interface of pin 18 with housing 22 via Swage-Lok 24. FIG. 4*a* depicts conductor 16, pin 18, conductor-pin connection 20, housing 22, Swage-Lok 24 (with outer collar 28, inner collar 30, and seal piece 32), and aperture 26.

As noted above, conductor 16 is formed of litz wire. In some embodiments, conductor 16 may be formed of multiple litz wire bundles of individually insulated wires. Pin 18 is a rigid pin or rod of a conductive material such as copper. Pin 18 meets conductor 16 at conductor-pin connection 20, which may be a sleeve or crimping clamp of pin 18 which surrounds conductor 16. The insulation of individual wires of conductor 16 is stripped away at conductor-pin connection 20. In some embodiments, individual wires of conductor 16 may be soldered together at conductor-pin connection 20 to form a solid conductive block. These individual wires are collectively crimped or soldered into conductor-pin connection 16, thereby allowing pin 18 to serve as an electrical connection to conductor 16. Each conductor 16 is connected to two pins 18, as shown in FIGS. 2 and 3. Embodiments of inductor 10 wherein conductor 16 comprises several distinct coils (e.g. coils 16*a*, 16*b*, and 16*c*) will feature two pins for each coil.

Aperture 26 is a hole or passage in housing 22 through which pin 18 is able to pass. Compression tube seal 24 is anchored in aperture 26, and provides a seal between pin 18 and housing 22. Compression tube seal 24 is a three-piece component such as a SwageLok compression tube fitting with outer collar 28, inner collar 30, and seal piece 32. Inner collar 30 is a rigid cylindrical component attached to housing 22. Inner collar 30 may, for instance, be welded to housing 22, or threaded into attachment threads in housing 22. Outer collar 28 is a second cylindrical piece which screws onto inner collar 30. Seal piece 32 is a slightly deformable ring sandwiched between inner collar 30 and outer collar 28. Seal piece 32 forms a friction seal with pin 18. Outer collar 28, inner collar 30, and seal piece 32 may all be formed of the same material (e.g. alloy steel). Compression tube seal 24 enables pin 18 to be readily removed and replaced. Removing and replacing pin 18 in aperture 26 requires replacing seal piece 32, but not inner collar 30, outer collar 28, or pin 18 itself.

Pin 18 acts as an electrical terminal which accessible to external electronics. External wiring can be clamped or soldered to pin 18 to connect inductor 10 to larger electronic systems.

Figure 4B:
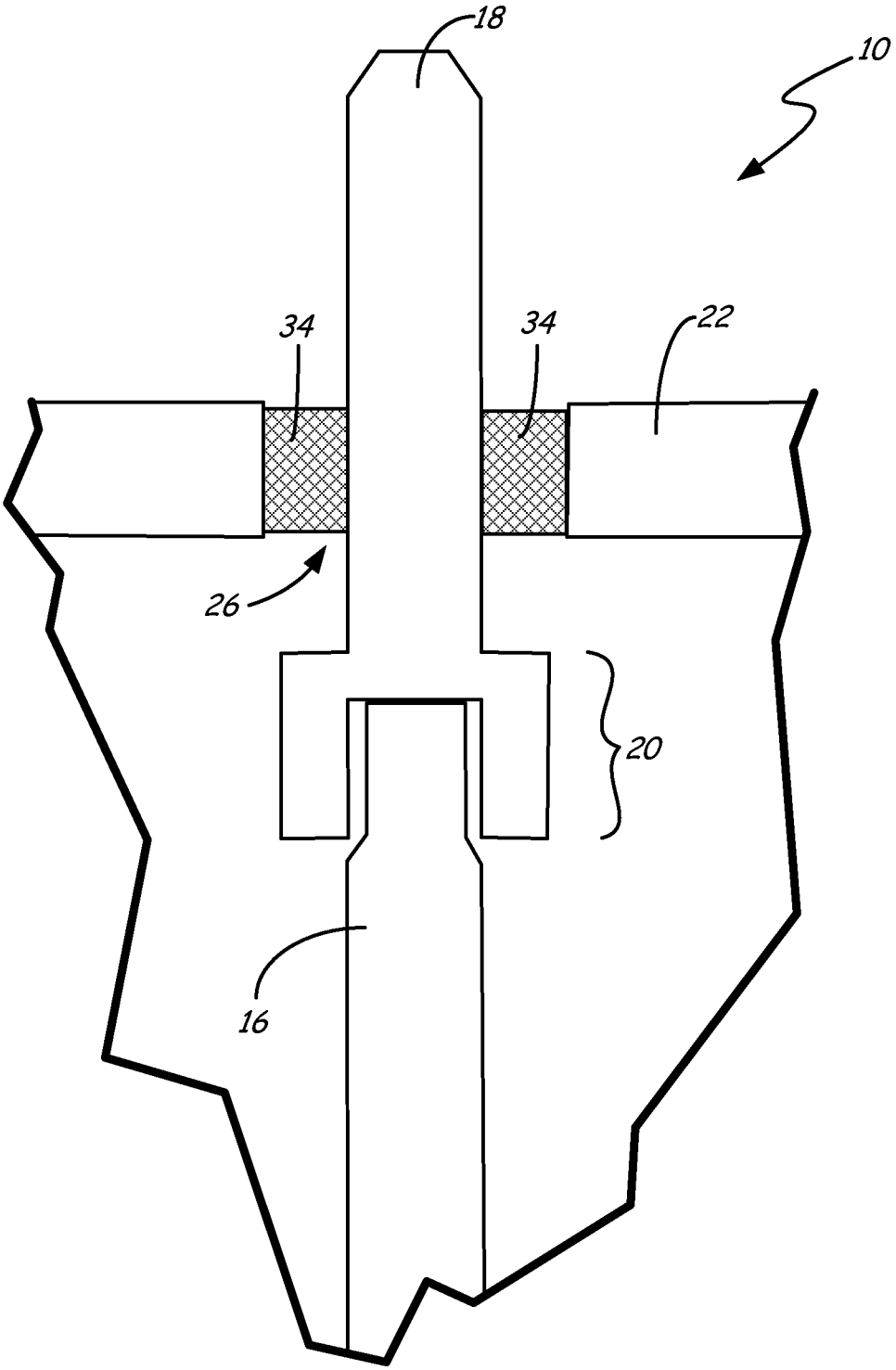
FIG. 4*b* is a simplified cross-sectional view of a second embodiment of a sealed connection for the inductor of FIG. 2.

FIG. 4*b* is a simplified cross-sectional view of inductor 10, focusing on the interface of pin 18 with housing 22 via hermetic beading 34. FIG. 4*b* depicts conductor 16, pin 18, conductor-pin connection 20, housing 22, aperture 26, and hermetic beading 34. Conductor 16 is attached to pin 18 via conductor-pin connection 20, as described above with respect to FIG. 4*a*. Pin 18 extends through aperture 26, and can be clamped or soldered to external wiring, as described above.

The embodiment of FIG. 4*b* eschews compression tube seal 24 in favor of hermetic beading 34, a semi-permanent beading of glass or epoxy which fills aperture 26 around pin 18, and anchors pin 18 to housing 22. Hermetic beading 34 fulfills substantially the same function as compression tube seal 24 at lower cost, but is not readily removable. If pin 18 is ever removed or replaced, hermetic beading 34 must be broken and reapplied. Thus, the embodiment of FIG. 4*b* is well suited to applications wherein core 12, bobbin 14, and conductors 16 are seldom removed from housing 22.

Figure 4C:
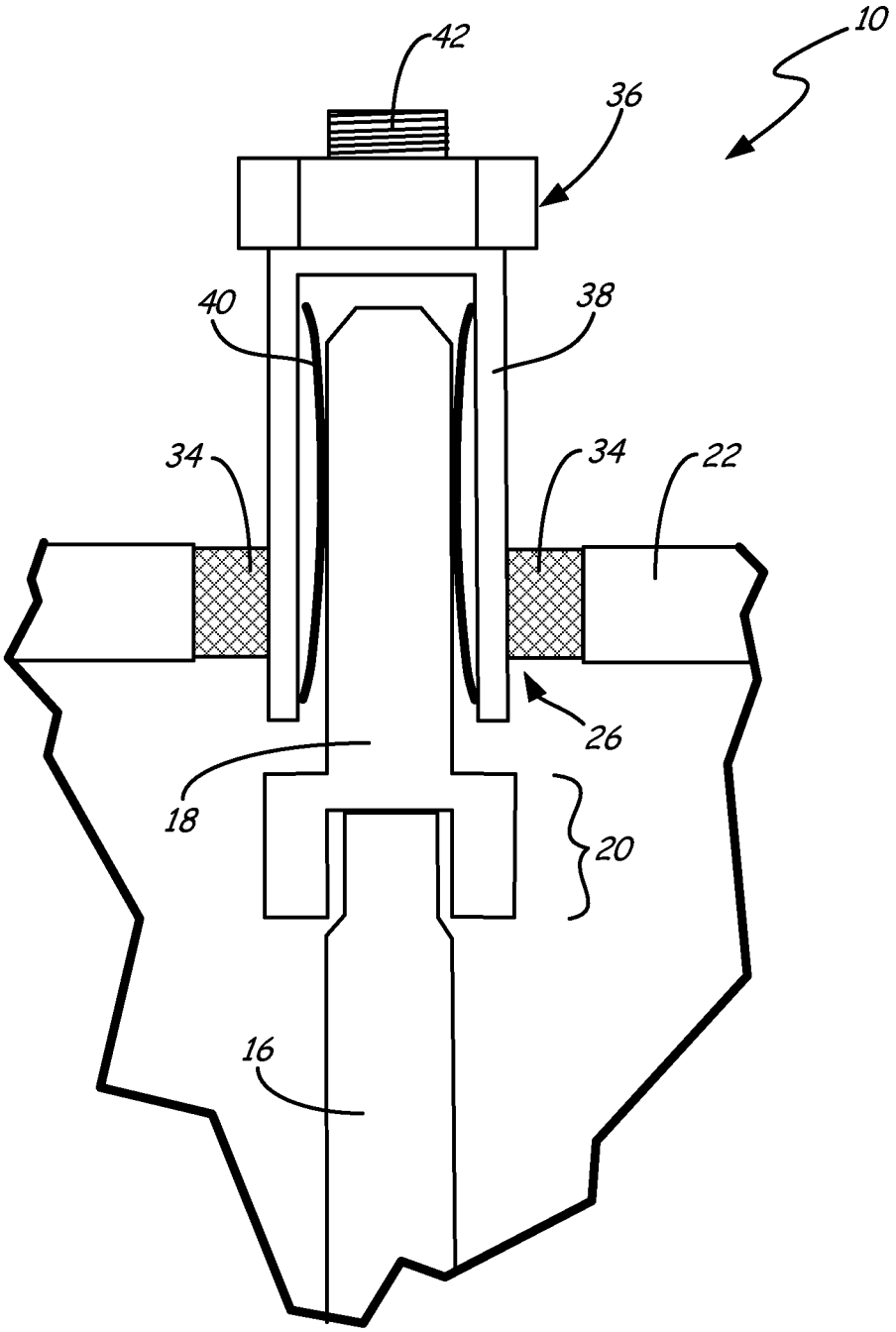
FIG. 4*c* is a simplified cross-sectional view of a third embodiment of a sealed connection for the inductor of FIG. 2.

FIG. 4*c* is a simplified cross-sectional view of inductor 10, focusing on the interface of pin 18 with housing 22 via contact socket 36 and hermetic beading 34. Contact socket 36 comprises conductive sleeve 38, conductive foils 40, and screw attachment 42. Conductor 16 is attached to pin 18 via conductor-pin connection 20, as described above with respect to FIGS. 4*a* and 4*b*.

Rather than attaching pin 18 directly to housing 22, hermetic beading 34 forms a sealed connection between contact socket 36 and housing 22. Hermetic beading 34 forms a semi-permanent connection between housing 22 and contact socket 36, but pin 18 can be freely inserted into or removed from contact socket 36 without destroying or disrupting hermetic beading 34. In some embodiments, hermetic beading 34 may be replaced with a sealed threaded connection, allowing contact socket to be screwed directly into housing 22. Contact socket 36 may be formed entirely of a single material, e.g. copper, and serves as a conductive contact for pin 18. As contrasted with the embodiments of FIGS. 4*a* and 4*b*, the embodiment of FIG. 4*c* does not lock pin 18 in place relative to housing 22. Instead, pin 18 can be freely slotted into or out of contact socket 36 without destroying or replacing any seal components.

Contact socket 36 comprises conductive sleeve 38, conductive foils 40, and screw attachment 42. Conductive sleeve 38 is a rigid cylindrical sleeve which passes through aperture 26 to surround pin 18. Conductive foils 40 are spring-deformable foils anchored to the interior of conductive sleeve 38. When pin 18 is inserted into conductive sleeve 38 of contact socket 36, conductive foils 40 deform to make way for pin 18. Conductive foils 40 serve both as an electrical contact between conductive sleeve 38 and pin 18, and a flexible anchor for pin 18. Contact socket 36 may be attached to housing 22 via hermetic beading 34 before inserting pin 18 into contact socket 36. Contact socket 36 and hermetic beading 34 together completely fill aperture 26, thereby sealing housing 22 against fluid egress.

Screw attachment 42 is a threaded conductive protrusion which extends from conductive sleeve 38 to provide an attachment point for external wiring. When pin 18 is inserted into conductive sleeve 38, and thereby deforms conductive foils 40, contact socket 36 acts as a terminal connection which for inductor 10. External wiring attaches to contact socket 36, rather than directly to pin 18 (as in FIGS. 4*a* and 4*b*). Although external wiring can be clamped or soldered to contact socket 36 in a fashion analogous to the connection means used with the embodiments of FIGS. 4*a* and 4*b*, screw attachment 42 allows external wiring to alternatively be attached via a threaded fastener, thereby avoiding the need to resolder or reclamp wires if inductor 10 is ever removed or replaced.

The sealing mechanisms of FIGS. 4*a*, 4*b*, and 4*c* allow inductor 10 to make contact with external electronics while sealed within housing 22 for fluid or immersion cooling. In particular, bobbin 14 supports and positions conductors 16 and pins 18 to relative to apertures 26. Apertures 26 are sealed with against fluid egress by hermetic beadings 34 or compression tube seals 24. litz wire provides an economical means for adding many turns to inductor 10. The sealing arrangements of FIGS. 4*a*, 4*b*, and 4*c* allow litz wire to be used for conductors 16 in embodiments of inductor 10 which must remain sealed to contain coolant fluid.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An inductor comprising:

a ferromagnetic core;

a litz wire conductor encircling the ferromagnetic core;

a first conductive pin conductively attached to the litz wire conductor, and extending from the litz wire conductor to form an external electrical contact for the inductor;

a housing enclosing the ferromagnetic core and the litz wire conductor, and provided with an aperture configured to accept the conductive pin;

a bobbin configured to support the litz wire conductor and position the conductive pin in alignment with the aperture; and a seal assembly configured to seal the aperture against fluid egress from within the housing.

2. The inductor of claim 1, wherein the first conductive pin is retained in a wire channel of the bobbin.

3. The inductor of claim 1, further comprising a second conductive pin parallel to the first conductive pin, and wherein the first and second conductive pins are located at inner and outer diameter walls of the bobbin, respectively.

4. The inductor of claim 1, wherein the seal assembly comprises a semi-permanent hermetic beading deposited between the housing and the first conductive pin.

5. The inductor of claim 4, wherein the semi-permanent hermetic beading is formed of glass or epoxy.

6. The inductor of claim 1, wherein the seal assembly is a compression tube seal comprises an inner collar, and outer collar, and a seal piece fitted about the first conductive pin and between the inner collar and the outer collar.

7. The inductor of claim 6, wherein the inner collar of the compression tube seal is soldered to or threaded into the aperture in a seal.

8. The inductor of claim 1, further comprising a clamp or solder connection between the first conductive pin and external electronics.

9. The inductor of claim 1, wherein the seal assembly comprises a contact socket in the aperture, configured to accept the first conductive pin.

10. The inductor of claim 9, wherein the contact socket comprises a conductive sleeve configured to receive the first conductive pin, and a conductive foil configured to deform in contact with the first conductive pin to create an electrical contact between the first conductive pin and the contact socket.

11. The inductor of claim 9, wherein the contact socket comprises a conductive screw attachment configured to provide an electrical contact between the first conductive pin and external wiring.

12. The inductor of claim 1, wherein the litz wire conductor comprises multiple distinct coils dedicated to different voltage phases, with two conductive pins for each of the distinct coils.

13. A sealed connection for a fluid-cooled inductor, the sealed connection comprising:

a litz wire conductor encircling a ferromagnetic inductor core;

a conductive pin conductively connected to and extending from the litz wire conductor;

a housing enclosing the litz wire conductor, the housing having an aperture configured to accept the conductive pin;

a seal assembly configured to seal the aperture against fluid egress from within the housing.

14. The sealed connection of claim 13, wherein the conductive pin is attached to the litz wire conductor via a crimping clamp, and wherein insulation is stripped from the litz wire conductor at the location of the crimping clamp.

15. The sealed connection of claim 13, wherein the conductive pin is soldered to the litz wire conductor at a conductive sleeve, and wherein insulation is stripped from the litz wire conductor at the location of the conductive sleeve.

16. The sealed connection of claim 13, wherein the seal assembly comprises a semi-permanent hermetic beading deposited between the housing and the conductive pin.

17. The sealed connection of claim 13, wherein the seal assembly is a compression tube seal comprising an inner collar, and outer collar, and a seal piece fitted about the conductive pin and between the inner collar and the outer collar.

18. The sealed connection of claim 13, wherein the seal assembly comprises a contact socket in the aperture, configured to accept the conductive pin.

19. The sealed connection of claim 13, wherein the contact socket comprises a conductive sleeve configured to receive the conductive pin, and a conductive foil configured to deform in contact with the conductive pin to create an electrical contact between the conductive pin and the contact socket.

20. The sealed connection of claim 13, further comprising a clamp or solder connection between the conductive pin and external electronics.

* * * * *